E196Z XR 4,097,025

United States Patent [19]

Dettmann et al.

[11] 4,097,025

[45] Jun. 27, 1978

[54] ELECTRONIC FENCE SURVEILLANCE APPARATUS

[75] Inventors: Charles R. Dettmann, Independence; John J. Frederick, Excelsior, both of Minn.

[73] Assignee: Electronic Surveillance Fence Security, Inc., Wayzata, Minn.

[21] Appl. No.: 706,500

[22] Filed: Jul. 19, 1976

[51] Int. Cl.[2] ..... E04H 17/00; G08B 21/00

[52] U.S. Cl. ..... 256/1; 340/261

[58] Field of Search ..... 340/261, 258 D, 258 R, 340/16 R, 253 Y; 256/10, 1

[56] References Cited

U.S. PATENT DOCUMENTS

| | | | |
|---|---|---|---|
| 3,750,127 | 7/1973 | Ayers et al. | 340/258 D X |
| 3,831,162 | 8/1974 | Armstrong | 340/261 |
| 3,833,897 | 9/1974 | Bell et al. | 340/261 |
| 3,836,899 | 9/1974 | Duvall et al. | 340/261 |
| 3,868,667 | 2/1975 | Skujins, Jr. | 340/261 X |

FOREIGN PATENT DOCUMENTS

| | | | |
|---|---|---|---|
| 1,391,178 | 4/1975 | United Kingdom | 340/261 |

OTHER PUBLICATIONS

New Products, Electronics, Automatic Alarm Systems, Jun., 1942.

*Primary Examiner*—Werner H. Schroeder
*Assistant Examiner*—Peter Nerbun
*Attorney, Agent, or Firm*—Frederick E. Lange

[57] ABSTRACT

Electronic fence surveillance apparatus in which a plurality of sections of relatively rigid electrical conduit are supported by the fence serially therealong and independently of the fence posts, the sections being connected by a plurality of liquid tight housings each interposed between and having a threaded liquid tight connection with the adjacent sections of conduit and in which there is a vibration sensor secured in each of the housings and responsive to vibrations transmitted to the housing in which it is located, each of the vibration sensors being effective to produce a vibratory electrical signal upon the conduit being vibrated and transmitting this signal to an indicating device through an electronic network. The vibration sensor is in the form of a piezoelectric element designed to operate within the range of frequencies occurring in the conduit when the fence is disturbed. The conduit is preferably of iron or steel and has a wall thickness of between 0.10 and 0.12 inches so as to have a relatively wide band of frequency transmission with relatively little attenuation. The electronic equipment includes a band pass amplifier between each group of sensors and the indicating device associated therewith. Provision is made for integrating the output of the band pass amplifier. The electronic apparatus may contain a number of band pass amplifiers, each of which is connected to a separate group of the sensors, and there may be two indicating devices, one of which is controlled by all of the band pass amplifiers and the other of which may be selectively connected to the amplifiers one at a time by a suitable selector switch. A flexible coaxial cable extends through the conduits interconnecting the various sensors in any one group to the electronic apparatus.

8 Claims, 7 Drawing Figures

ELECTRONIC FENCE SURVEILLANCE APPARATUS

BACKGROUND OF THE INVENTION

It is quite common to employ a wire fence as a barrier surrounding an area to be protected. It is imperative, however, if the area is to be adequately secured, to provide some means for providing an alarm or warning if any attempt is made to cut, climb or otherwise interfere with the fence. Various devices have been developed in the past for monitoring such a fence and giving such a warning if any attempt is made to interfere with the protective function of the fence. In some cases, this has taken the form of a coaxial cable treated so that the dielectric between the inner and outer conductors functions as an electret. This has the drawback, among others, that the device of the apparatus is relatively expensive. Furthermore, the frequency response of such a cable is somewhat limited in band width. Arrangements have also been proposed in which acoustical microphones have been employed. Here, however, the apparatus is subject to noise produced by a passing vehicle, such as a snowmobile. It has also been proposed in connection with acoustical microphones to use "thin wall" conduit for enclosing the conductors extending between the microphones. Such thin wall conduit tends, however, to unduly attenuate the vibrations passing therethrough. Furthermore, since "thin wall" conduit cannot be threaded, it becomes difficult to provide completely weather tight connections of the conduit to the associated equipment.

A number of other arrangements have been proposed for guarding such a fence, but none of these have been simple, watertight, effective over a wide range of frequencies, and capable of being nonresponsive to ambient noise produced, for example, by passing vehicles.

SUMMARY OF THE INVENTION

The present invention is concerned with electronic fence surveillance apparatus in which use is made of relatively rigid electrical conduit is suspended from the fence and which is connected in a watertight manner with junction boxes in which is located a vibration sensor responding to the vibrations transmitted through the rigid conduit and producing an electrical signal in accordance with such vibrations. The electrical conduit is preferably of a metal such as iron or steel and has a relatively thick wall, for example, of a thickness between 0.10 and 0.12 inches. Preferably, coaxial cable is loosely disposed in the conduit and is effective to connect a series of the sensors together.

In one form of my invention, an indicating device is employed with connecting means operatively connecting a group of the sensors to this indicating device.

It is further contemplated that there be a plurality of groups of sensors, each group of which may be selectively connected through a suitable band pass amplifier to one indicator. All of the groups of sensors may be connected to another indicator. In such case, the first indicator is used to indicate the particular area at which a disturbance has occurred whereas the second indicator is used to indicate whether any disturbance has occurred at any point along the fence.

The sensor preferably takes the form of a piezoelectric element which is designed to operate within the range of frequencies occurring in the conduit when the fence is disturbed. This piezoelectric element is mounted within the secured to the junction box connecting the adjacent sections of conduits.

As indicated above, a band pass amplifier may be connected between each group of sensors and the indicating device. The output of this band pass amplifier may be integrated and the indicating device may be responsive to the integrated output of such a band pass amplifier.

Various other features of the invention will be apparent from a consideration of the accompanying specification, claims and drawing.

DESCRIPTION OF THE PREFERRED EMBODIMENT

Figure 1:
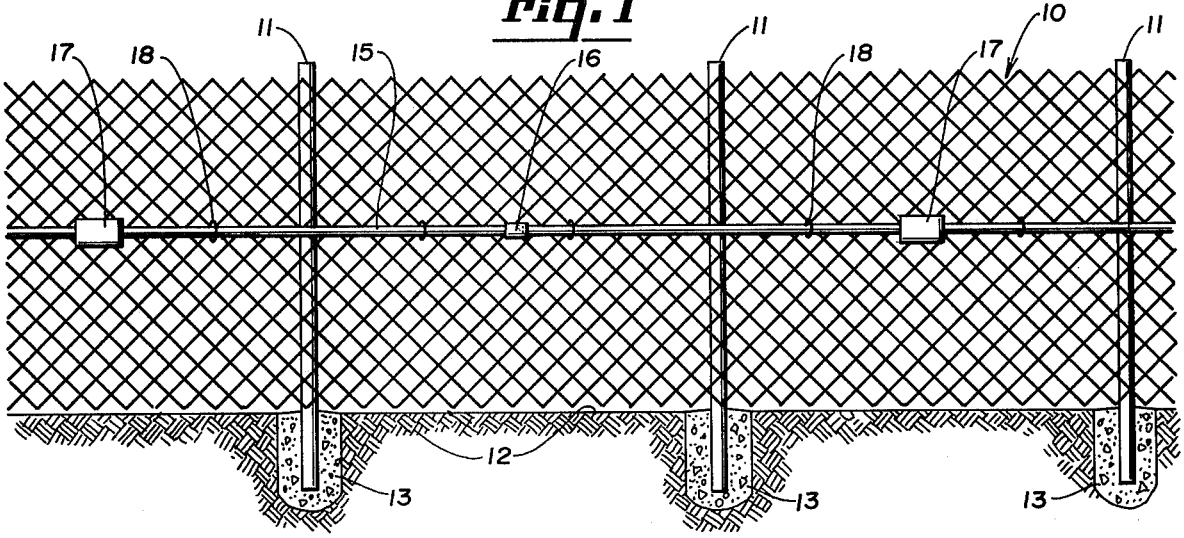
FIG. 1 is an elevational view, partly schematic, showing a section of fence having our surveillance apparatus secured thereto.
Figure 6:
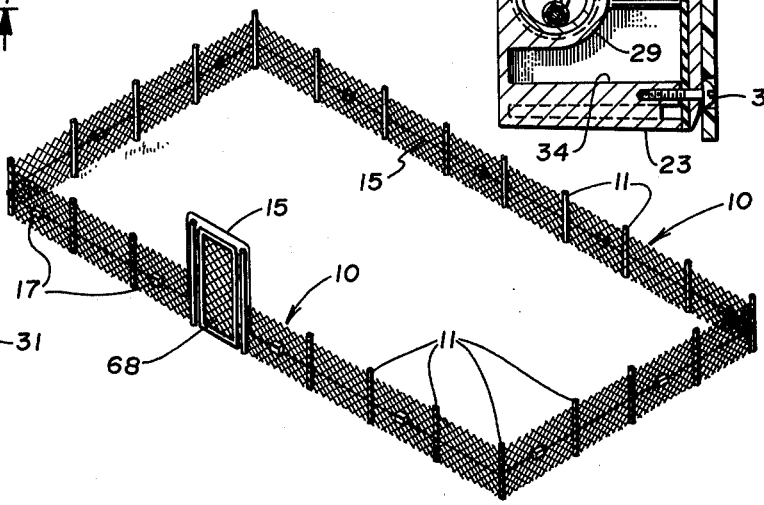
FIG. 6 is a view of an entire fence enclosing a given area showing the conduit and the groups of sensors.

Referring to FIG. 1 of the drawing, the reference numeral 10 is used to indicate a fence to be protected. This fence may typically be of the chain link type and is firmly supported on periodically spaced posts 11 fastened into the ground 12 by, for example, being embedded in concrete as indicated at 13. As best indicated in FIG. 6, the fence 10 may enclose an area to be protected.

Referring now to the intrusion detection apparatus of the present invention, this comprises a plurality of sections of rigid conduit 15. These sections of pipe may be coupled together by suitable coupling devices 16 and by junction boxes 17. As will be presently described, the conduit 15, while acting to house electrical conductors passing therethrough, also forms a vital part of the intrusion device in its function of transmitting vibrations imparted to the pipe to the vibration sensor within the adjacent box 16. The pipe and the junction boxes 17 are supported from the fence 10 by suitable fastening means 18. This may take the form of ties which are wrapped around the conduit 15 and secured to the fence. It will be noted that the sections of conduit 15 and the junction boxes 17 are secured to the fence independently of the posts 11.

Referring now to the conduit 15, each section of conduit 15 is preferably a section of conventional "rigid" electrical conduit of the type used in electrical wiring. The conduit normally employed is either half-inch or three-quarter inch conduit and is customarily of a ferrous material such as iron or steel, as previously pointed out. A typical half-inch conduit of this type has an internal diameter of 0.622 inches and an external diameter of 0.840 inches. Thus, the thickness of the wall is approximately 0.109 inches. Where a three-quarter inch conduit is employed, such conduit typically has an internal diameter of 0.824 inches and an external diameter of 1.050 inches. Thus, in the case of the three-quarter inch conduit, the wall thickness is approximately 0.113 inches. Such rigid conduit is markedly different from "thinwall" conduit often employed in electrical wiring and which has been employed in certain prior art surveillance systems. A characteristic difference between so-called "rigid" conduit and so-called thinwall conduit is that the rigid conduit is customarily threaded and couples with junction boxes by means of threaded connections. Thinwall conduit, on the other hand, cannot be threaded, due to its much thinner wall and is customarily held in the junction box by various clamping types of fittings.

Figure 2:
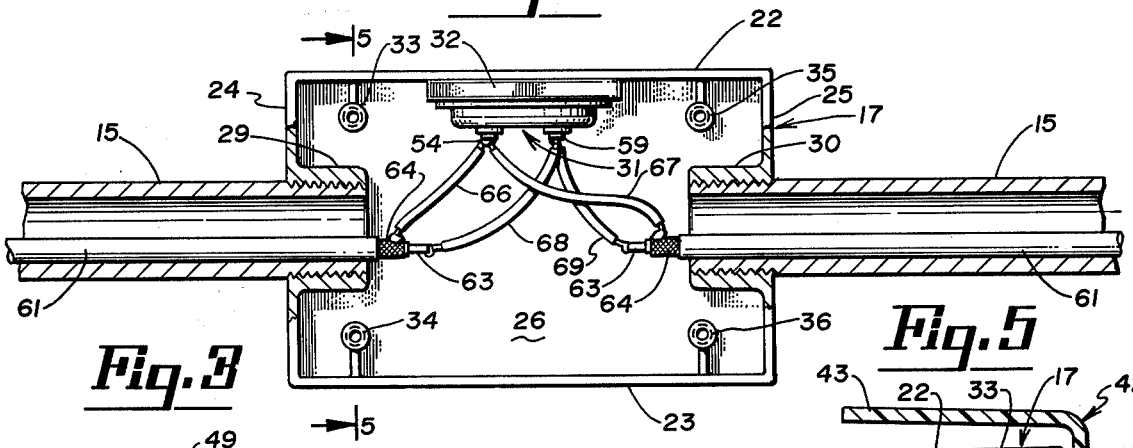
FIG. 2 is a view, withethe cover removed and portions in section, of a junction box with two sections of conduit connected thereto and showing a sensor secured within said box and connected to coaxial cable extending through the sections of conduit.
Figure 5:
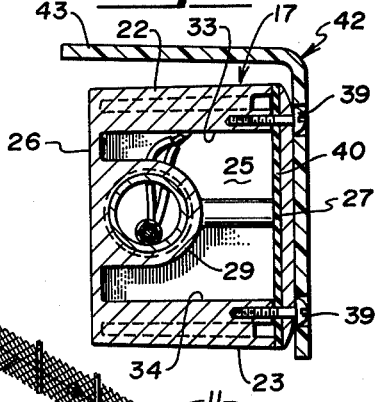
FIG. 5 is a sectional view along the line 5—5 of FIG. 2 but with the cover for the box added thereto.

Referring now to FIG. 2, the junction box 17 is shown, partially in section and with the cover plate removed therefrom. In FIG. 5, I have shown this same junction box in section, the section being taken along the line 5—5 of FIG. 2. It will be noted from FIGS. 2 and 5 that the box basically is a rectangular box having an upper wall 22, a lower wall 23, end walls 24 and 25, a rear wall 26 and a removable front wall 27. The box 17 is provided with a plurality of inwardly extending nipples 29 and 30 which have an interior threaded opening to receive the threaded ends of the adjacent sections of conduit 15. Preferably, the ends of the conduit 15 are slightly tapered and the openings in the inwardly extending nipples 29 and 30 are similarly tapered. Thus, as the conduit 15 is screwed into the nipple 29 or 30, the connection is made tighter the further that the conduit is screwed in. Because of the need for insuring against any moisture entering the box 17 as will be explained later, we employ a sealing compound of the type commonly referred to as "pipe dope" between the conduit 15 and the nipples 29 and 30. This is placed on the threaded conduit before it is screwed into the nipples and insures against any moisture seeping into the box along the threaded connections.

Within each box 26 there is located a vibration sensor 31. This is secured to the inner surface of top wall 22 of the box 17 by being secured to a layer of insulating material 32 which in turn is adhesively secured to the under side of the box 17. The insulating material 32 may be of any suitable material providing adequate insulating and structural properties. A typical material suitable for this purpose is a polymerized methyl methacrylate sold under the trade name of Lucite or Plexiglas. Continuing with the structure of the junction box 17, the junction box is provided with four posts 33, 34, 35 and 36 which extend from the back wall 26 of the housing and terminate at a plane substantially flush with the front edges of the side walls 22, 23, 24 and 25. Each of these posts 33, 34, 35 and 36 is provided with a threaded aperture therein for the purpose of securing the front cover plate 27 thereto. The front plate 27 is clamped in position by two pairs of screws 39. Interposed between the front cover plate 27 and the side walls 22, 23, 24 and 27 is a gasket 40. Upon the screws 39 being threaded into the openings in posts 33, 34, 35 and 36 through the corresponding openings in the front plate 27 and upon the screws 39 being tightened, the cover 27 presses firmly against the gasket 40 and maintains a fluid tight seal with the sides of the box 17.

In order to further guard against the entrance of any moisture into the box 17, a rain shield 42 which is L-shaped in cross section is secured to the cover plate 27. It will be noted that the rain shield 42 has a horizontally extending portion 43 which extends over the top of the box 17 and prevents rain from directly contacting the box 17. It will be seen from the above that the arrangement provides a highly water-tight housing. Due to the sealant between the conduit 15 and the nipples 29 and 30, moisture cannot pass through the threaded connections of the conduit 15 to the box 17. Similarly, the front of the housing is thoroughly sealed by reason of the gasket 40. In addition, the rain shield 42 minimizes the contact of water with the box 17. Inasmuch as the nipples 29 and 30 as well as the posts 33 through 36 are integral with the box 17, no moisture can enter through any connections of these elements with the box. Furthermore, as will be pointed out in more detail later, because of the rigid connections of conduit 15 with the box 17 and because of the relatively large thickness of the walls of conduits 15, any vibration imparted to the conduit 15 is transmitted through to the box 17 with relatively little attenuation. Moreover, as will be discussed later, the conduit 15 is capable of transmitting vibrations over a wide range of frequencies without any attenuation.

Figure 3:
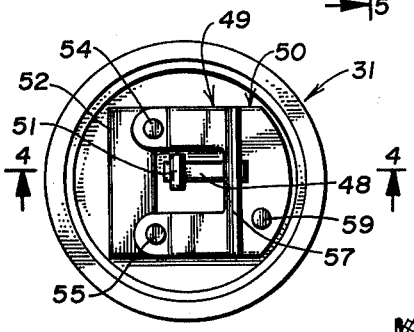
FIG. 3 is a top plan view of the sensor of the present invention, the view being on a somewhat larger scale than in FIG. 2.
Figure 4:
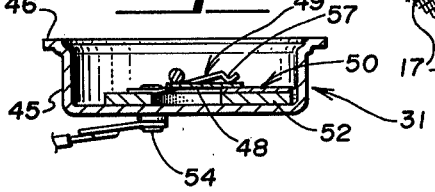
FIG. 4 is a sectional view of the sensor, the section being taken along the line 4—4 of FIG. 3.

Referring now to the sensor 31, best shown in FIGS. 3 and 4, this sensor comprises a cup-shaped housing 45 having an outer flange 46 at the outer edge thereof (as viewed in FIG. 4). It is this flange 46 which supports the sensor and is secured to the insulating layer 32 to separate the sensor from the housing. Referring to the internal portions of the sensor, the active element is a strip 48 of piezoelectric material which is held between two contact members generally indicated at 49 and 59. The right hand end of the piezoelectric strip 48 is clamped between these two contact members and the left hand end has secured thereto a suitable mass 51 which is selected and positioned so as to obtain a desired frequency of vibration of the piezoelectric material. Referring to the contact members 49 and 50, these are mounted on the housing 45, being spaced therefrom by a sheet of insulating material 52. Contact member 49 is generally U-shaped in character and has two legs which are riveted to the casing by rivets 54 and 55 which are insulated from the casing so as not to be in electrical contact therewith. One of these rivets, for example, rivet 54, may function as an electric terminal for facilitating the connection of an electrical conductor thereto. The electrical contact member 49, as pointed out previously, is basically U-shaped. The base 57 of this member extends transversely with respect to the legs of the contact member 49 and with respect to the piezoelectric 48. As will be noted from FIG. 4, this contact member is provided with a groove therein to form a lower curved base 57 which engages the piezoelectric element 48. Because of the resiliency of contact member 49, the base 57 is of the U-shaped contact member 49 tends to clamp the piezoelectric material in position and hold it between contact members 49 and 50. Referring to the contact member 50, the general contour of which is best shown in FIG. 3, this member likewise is riveted in position to the case 49 by a rivet 59. Because it rests upon the insulating layer 52 and because it is fastened to the base by means of a rivet 59 which is insulated from the case, the contact member 50 is electrically insulated from the case and has no electrical contact therewith. Again, the rivet 59 can be formed at its lower end to act as an electrical terminal to which leads can be attached, as shown in FIG. 2.

It will be readily apparent that any vibration present in conduit 15 is transmitted through the walls of housing 17 to the casing 45 of the sensor 31. This will, in turn, cause varying pressure to be exerted upon the piezoelectric element 48 to cause it to induce an electrical signal of a frequency corresponding to that of the vibrations transmitted through conduit 15. While the piezoeletric element tends to produce a greater signal at a predetermined frequency, the piezoelectric element will, however, induce signals of varying frequency depending upon the frequency of vibration imparted thereto.

As will be pointed out, the various sensors 31 are connected together in parallel in groups. In order to connect these sensors together and to the electronic portion of our apparatus, we use coaxial cable. A separate section of coaxial cable is employed between each set of boxes 17, these sections being designated in the drawing by the reference numeral 61. The flexible cable is of any conventional type which is of a size that can be readily drawn through the conduit. In a typical case where the conduit is half-inch conduit, the coaxial cable may have a diameter of less than one-quarter of an inch. The cable is typically formed of a central conductor and an outer braided conductor coaxial therewith and insulated therefrom, the outer conductor being protected by an overlying layer of flexible insulating material. Unlike prior devices, the insulating material is not polarized and has no appreciable piezoelectric effect. in FIG. 2, I have shown sections of the coaxial cable being cut away to facilitate the making of electrical connections thereto. It will be noted that the central conductor is designated by the reference numeral 63 and the outer coaxial braided conductor by the reference numeral 64. The outer braided conductor 64 is connected by a conductor 66 to the terminal 54 and by a second conductor 67 to the braided conductor 64 of the next section of coaxial cable 61. Similarly, the inner central conductor 63 is connected by a conductor 68 to the terminal 59 of the sensor 31 and by conductor 69 to the central conductor 63 of the next section of coaxial cable 61. It will thus be apparent that the sensor 31 is connected in parallel between the conductors 63 and 64 of the coaxial cable. The sensors 31 in other boxes 17 will likewise be connected in the same manner to the two conductors 63 and 64 of the coaxial cable. As will be explained in more detail later, the sensors 31 are connected in groups so that it is possible, by determining in which group vibration has been sensed, to determine in what portion of the fence the disturbance has occurred.

Before going to the electrical circuitry employed in connection with our apparatus, reference will briefly be made to FIG. 6 which shows an area enclosed by a fence 10 protected by the apparatus of the present invention. It will be noted that there are a series of fence sections 10 supported by posts 11 and forming an enclosed area. The fence is provided with a gate 68 and the various sections of conduit connected together by junction boxes 17, in each of which is located a sensor 31, extend over the entire extent of the fence. At the gate 68, the conduit 15 is bent upwardly and extends over the top of the gate. In some cases, the conduit may extend downwardly beneath the gate. Where ever an angle is encountered such as at the corners of the fence or over the top of the gate, it is possible to bend the conduit 15 to go around the corner or up above the gate. While the conduit employed is of the so-called rigid type, it can still be bent by the use of a proper conduit bender.

Figure 7:
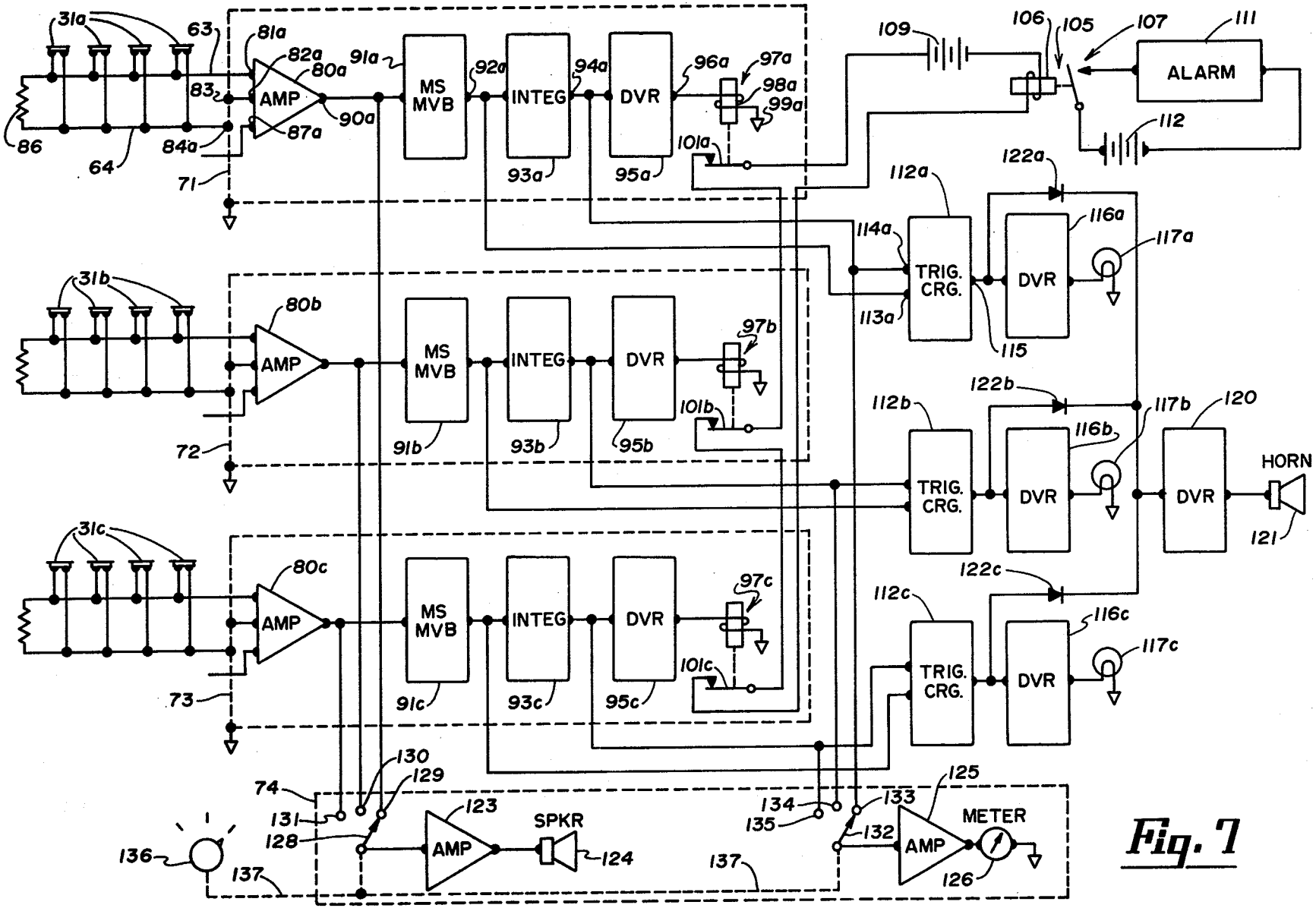
FIG. 7 is a schematic view of the electrical apparatus employed in the present invention.

Referring now to FIG. 7, the electrical circuitry in connection with my apparatus is shown in schematic form. It will be noted that at the left hand side of the drawing, there are a plurality of sensors shown schematically and arranged in groups designated **31*a*, 31*b* and 31*c*. I have shown four sensors in each group and have shown three groups. The number of sensors in each group can, however, be varied and the number of groups will of course depend upon the length of the fence being protected. It is to be understood that one of the sensors will be in each box 17 and the total number of sensors 31 will depend upon the number of junction boxes 17 in connection with a fenced-in enclosure such as shown in FIG. 6**. This will, in turn, depend upon the area of the region which is enclosed by the fence.

The apparatus, as shown in FIG. 7, includes three audio boards 71, 72, and 73, each being enclosed in a housing shown in dotted lines. Each of these audio boards is controlled by a different group of sensors. Thus, audio board 71 is controlled by the sensors designated as sensors **31*a*, the audio board 72 is controlled by the sensors 31*b* and audio board 73 is controlled by sensors 31*c*. There is also a low level alarm which can be selectively connected to any one of the audio boards 71, 72 and 73. The apparatus of this low level alarm is enclosed in a housing represented by dotted lines and is designated by the reference numeral 74**. There are also various other alarm circuits which will be described and which indicate whether a disturbance has occurred in any one section of the fence.

Referring first to the audio board 71, this includes an amplifier **80*a* which is preferably a band pass amplifier which passes frequencies of between, for example, 200 to 7,000 Hz. The amplifier has one input terminal 81*a* which is connected to conductor 63 which, as is evident from FIG. 2, is the central conductor of the various sections 61 of coaxial cable. The amplifier 80*a* has a second input terminal 82*a* which is connected to the grounded case surrounding the audio board 71 by a ground connection 83*a*. The conductors 64 of the coaxial cable 61 which, it will be recalled, are connected to terminals 54 of the sensors, are connected at 84*a* to the grounded case of the audio board 71. Thus, the various sensors 31*a* are all connected in parallel to the input terminals 81*a* and 82*a* of band pass amplifier 80*a*. The outer ends of conductors 63 and 64 are connected together by a relatively high resistor 86*a* so that a current can be applied to the circuit including conductors 63 and 64 and resistor 86*a*** to test the continuity of this circuit.

The band pass amplifier **80*a* may have a further input terminal 87*a* to which may be connected other sensors, either of the type of sensors 31*a*** or microphones located within the area being enclosed, for example, within a building within the area. Since the microphones form no part of the present invention, they have not been shown.

The amplifier **80*a* is provided with an output terminal 90*a* which is connected to the input of a conventional monostable multivibrator 91*a*, designated by the legend MS MVB. Such mulitvibrators are quite conventional and need not be described in detail. In general, when they receive an input signal above a predetermined amplitude, they are effective to cause an output signal of a predetermined magnitude which continues for a length of time determined by the internal constants of the circuit. Thus, a square wave is produced, the beginning of which is determined by the reception of a signal from the output terminal 90a of the band pass amplifier 80a and the duration of which is determined by the internal constants of the multivibrator. Of course, if there are a series of disturbances sensed by the sensors 31a, there will be a series of such square waves. The output terminal 92a of multivibrator 91a is in turn connected to the input terminal of an integrator 93a. Such an integrator, as is common, comprises a capacitor connected to a charging circuit with a relatively small RC value and a discharge circuit having a relatively high RC value. This will produce an output, the average magnitude of which is dependent upon the magnitude and frequency of the square waves appearing at the output terminal 92a of multivibrator 91a. The output appearing at the output terminal 94a of integrator 93a** will be equal to magnitude to the integrated value of such square waves.

The output of integrator 94 appearing at output terminal 94a is, in turn, connected to the input of a driver amplifier 95a which may be of conventional construction and which has an output 96a connected to the coil of a relay 97a. The relay 97a has a coil 98a, one terminal of which is connected to the output terminal 96a of driver amplifier 95a and the other terminal of which is grounded at 99a. It is understood that the output of driver amplifier 95a appears between output 96a and ground so that the coil 98a of relay 97a is energized whenever there is an output above a predetermined magnitude appearing at output terminal 96a. The relay 97a also includes a normally closed relay switch blade 101a. Driver amplifier 95a is designed to have, in the absence of an input from integrator 93a, an output sufficiently high to maintain relay coil 98a energized. When an input signal is received from integrator 93a, the output of driver amplifier 95a drops to deenergize relay coil 98a.

Briefly summarizing the operation, whenever a signal is sensed by any of the sensors 31a, an input signal is applied to the band pass amplifier 80a. If the frequency of the disturbances is within the range of the band pass amplifier, the signal is amplified and transmitted to the input terminal of the monostable multivibrator 91a. The output of this is integrated by integrator 93a to cause the output of driver amplifier 95a to drop to deenergize the winding 98a and open the normally closed relay switch 101a. As will be pointed out later, the outputs of the band pass amplifier 80a, the monostable multivibrator 91a, and the integrator 93a are also used for other functions.

The audio boards 72 and 73 are basically the same as audio board 71. In order to enable a ready comparison of the audio boards 72 and 73 with audio board 71, the corresponding elements in the three boards have been assigned the same numbers but have been provided with suffix letters *b* and *c*, respectively. With this explanation, it will be clear that if a disturbance of a frequency within the range of the band pass filter 80b or 80 c is sensed by the sensors 31b or 31c, respectively, these signals will be passed through to the multivibrator of the unit, integrated by the integrator and through the action of the driver amplifier, will be effective to deenergize the relay within that unit. Thus, if a disturbance is sensed by any of the sensors 31b, relay 97b will be deenergized to open the normally closed relay switch 101b. Similarly, if a disturbance within a particular frequency range is sensed by any of the sensors 31c, the relay 97c will be deenergized to open the normally closed relay switch 101c.

The relay switches 101a, 101b and 101c collectively control the energization of a further relay 105 having a relay coil 106 and a relay switch 107. The relay coil 106 of relay 105 is connected in a series circuit including the relay switches 101a, 101b and 101c and a battery 109. Battery 109 is shown schematically as a source of power. Normally, the source of power will be derived from some commercial source of power with a standby battery in case of power failure. The same will be true of the source of power (not shown) necessary to energize amplifiers 80a, 91a, 93a, 95a and the corresponding circuit components of audio boards 72 and 73. The relay switch 107 is biased to closed position but is maintained in open position as long as relay coil 106 is energized. This switch is connected in series with an alarm 111 and a suitable source of power such as a battery 112. Again, the source of power may actually be a commercial source of power with a standby battery in case of power failure.

It will be readily apparent from the above that if a disturbance of a frequency falling within the range of the band pass filters 80a, 80b or 80c is sensed by any of the sensors 31 and this frequency is of sufficient magnitude to cause operation of the equipment in the manner described, one or the other of the three relay switches 101a, 101b and 101c will be opened to cause deenergization of the relay coil 106 of relay 105 to in turn permit the switch 107 to be moved to closed position by its biasing means. This will cause a circuit to be established through the alarm 111. It is to be understood that in normal practice the alarm 111 may be located somewhat remote from the electronic circuitry shown in FIG. 7. For example, the alarm 111 may take the form of a horn on a post outdoors while the majority of the equipment shown in FIG. 7 may be located within a control panel located within a building. In some cases, where the alarm system is connected to a police station, for example, the alarm 111 may be located in the police station to alert the police that a break-in has been attempted in the area enclosed by fence 10.

In addition to the apparatus described above, including alarm 111 which may be at a remote point, there is associated with the panel board a number of other alarm or indicating devices. For example, there is associated with each audio board 71, 72 and 73 an alarm arrangement for indicating when a disturbance has occurred within that particular section. Referring to audio board 71, there is a trigger circuit 112a which may be of the conventional Schmidt trigger type. Such a Schmidt trigger has the characteristic that when an input signal is applied to an input terminal thereof, a square wave of a predetermined amplitude will be produced at its output terminal. This square wave will be maintained for as long as the input signal is above a predetermined value. As soon as the input signal drops below the predetermined value, the output of the square wave will drop to zero and the square wave will terminate. In other words, a square wave is produced which has a constant amplitude and which has a duration dependent upon the time that the input signal remains above a predetermined value. The trigger circuit 112a has two input terminals 113a and 114a. Input terminal 113a is connected to the output terminal 92a of the multivibrator 91a whereas input terminal 114a is connected to the output terminal 94a of integrator 93a. The purpose of the two input terminals 113a and 113b and their connection respectively to the output of the multivibrator and the integrator is to insure that the output of the trigger circuit will remain during the entire time that the integrator 93*a* has a substantial output. In other words, the Schmidt trigger circuit 112*a* is initially triggered when a voltage first appears at the output of the multivibrator and this voltage continues as long as the output of the integrator remains above a predetermined value. The output of trigger circuit 112*a* appearing at output terminal 115 is applied to the input terminal of a driver amplifier 116*a*, the output of which is in turn connected to some signalling device such as a lamp 117*a*. Thus, whenever a disturbance is sensed by any of the sensors 31*a* and the disturbance is of a frequency passed by the band pass amplifier 80*a*, the trigger circuit 112*a* will be energized to in turn energize the driver 116 to energize the lamp 117*a*. A similar trigger circuit 112*b*, a driver circuit 116*b* and a lamp 117*b* are provided in connection with audio board 72. Thus, whenever a disturbance is detected by any of the sensors 31*b* and this disturbance is of a frequency to be passed by the band pass amplifier 80*b*, the trigger circuit 112*b* is energized to in turn cause illumination of the lamp 117*b* or energization of any other signal device provided in lieu thereof. Likewise, a trigger circuit 112*c*, a driver circuit 116*c* and a lamp 117*c* are provided in connection with the sensors 31*c* and are effective to cause illumination of the lamp 117*c* or other signalling device whenever a disturbance is sensed by any of the sensors 31*c* which is of a frequency within the range of response of the band pass amplifier 80*c*. It will thus be seen that if a disturbance occurs in any section of the fence, this is indicated by one of the indicators 117*a*, 117*b* or 117*c* and it is possible to readily determine which section of the fence is being disturbed by noting which light is energized. It will be understood that the lights 117*a*, 117*b* and 117*c* are mounted in front of a display panel with suitable indicia to indicate the location of the fence being disturbed.

Not only does the apparatus indicate which section of the fence is being disturbed but, regardless of which section is being disturbed, there is a further indicating device that is energized. The numeral 120 indicates a driver amplifier bearing the legend DVR in the drawing. The output of this is connected to a horn 121 which may be part of the equipment of the display panel. The input to driver amplifier 120 is connected to the output of the trigger circuits 112*a*, 112*b* and 112*c*. In the case of amplifier 112*a*, the connection is through a diode 122*a*. In the case of trigger circuit 112*b*, the connection is through a diode 122*b*; and in connection with trigger circuit 112*c*, the connection to driver amplifier 120 is through a diode 122*c*. The function of the diodes 122*a*, 122*b* and 122*c* is simply to avoid any interconnection between the three circuits involving the trigger circuit and the driver. Obviously, if there were not such diodes or some other means for blocking the interconnection, a trigger signal appearing at the output terminal 115 of, for example, trigger circuit 112*a* would not only energize the driver amplifier 116*a* but also driver amplifiers 116*b* and 116*c*. By providing the diodes 122*a*, 122*b* and 122*c*, however, a signal may be transmitted from any one of the three trigger circuits to the driver amplifier 120 without being transmitted to the other of the driver circuits 116*a*, 116*b* and 116*c*. The effect of such a signal being applied to driver amplifier 120 is to cause the horn 121 to be sounded.

Thus, with the rather simple arrangement shown, it is possible to have not only an indication at the panel of which section of the fence is being disturbed but, regardless of which section is being disturbed, of a warning that the fence is being disturbed. If the person monitoring the surveillance apparatus is alerted to the fact that a disturbance has occurred at a particular section of the fence, by reason of one or more of the lamps 117*a*, 117*b* and 117*c* being illuminated and by reason of the horn 121 having been actuated, it is desirable to determine more carefully the nature of the disturbance. Consequently, we have provided low level monitor 74 which can be selectively connected to one of the audio boards which is connected to the sensors from which the signal has been derived, as determined by which of the lights 117*a*, 117*b* and 117*c* has been illuminated. Referring to this low level monitor, the numeral 123 is employed to indicate a power amplifier, the input of which is adapted to be selectively connected to the appropriate circuit board, as will be presently described. The output of amplifier 123 is connected to a speaker 124. Unlike the horn 121 which merely produces a pronounced sound when energized, the speaker 124 has a relatively wide range of frequency response and has an output indicative of the nature of the signal appearing at its input. Hence, the speaker enables one, when the amplifier 123 is connected to the appropriate audio board, to listen to the disturbances occurring at the sensor which is producing the signal.

The low level monitor also has a buffer amplifier 125, the input to which is again adapted to be selectively connected to the appropriate audio board. The output of the buffer amplifier is connected to a meter 126. The meter 126 is designed to be deflected in accordance with the magnitude of the signal applied to the buffer amplifier 125. The function of the buffer amplifier is not only to amplify the signal applied thereto but also to isolate the meter 126 from the elements in the audio boards to which it is connected.

As previously indicated, provision is made in connection with the low level monitor to connect it selectively to one of the audio boards. This is done in the case of power amplifier 123 by a selector switch having a switch blade 128 which may selectively be moved into engagement with contacts 129, 130 and 131. Contact 129 is connected to the output terminal 90*a* of the band pass amplifier 80*a*; contact 130 is connected to the output terminal of band pass amplifier 80*b*; and contact 131 is connected to the output terminal of band pass amplifier 80*c*. In connection with the buffer amplifier 125, the input terminal is connected to a switch blade 132 which is selectively movable into engagement with contacts 133, 134 and 135. Contact 133 is connected to the output terminal 94*a* of integrator 93*a*; contact 134 is connected to the output terminal of integrator 93*b*; and contact 135 is connected to the output terminal of integrator 93*c*. The two switch blades 128 and 132 are connected to a selector knob 136 by suitable mechanical connections schematically represented by the numeral 137. It will of course be understood that the knob 136 can be located on the front of the instrument panel and that the various positions thereof will be indicated by appropriate indicia.

OPERATION

In operation, the equipment shown in FIG. 7, with the exception of the sensors 31, the relay 105, power source 112 and alarm 111 are all located within a control panel. The conductors 63 and 64 may be introduced into the panel by connecting the rigid conduit to the walls of the panel housing, the outer conductor 64 of the coaxial conductors being grounded to the panel. The various sections of conduit 15, as previously explained, are secured to the fence by suitable fastening means 18 such as ties. The sections of rigid conduit 15 are secured to the boxes 17 in a liquid tight manner by being threaded therein after having a sealant applied to the threaded ends. Not only are the conduits 15 secured in a watertight manner to the boxes 17 but they are also secured rigidly thereto so that any vibration imparted to the conduits 15 is also imparted to the boxes 17 in which are housed the sensors 31. Thus, upon any disturbance of the fence occurring, one or the other sections of the conduit 15 will have vibration imparted thereto. The frequency of this vibration will depend upon the nature of the disturbance. Typical disturbances may involve someone attempting to climb the fence, someone cutting the fence, some sawing the fence, and even someone trying to tamper with one of the boxes 17. It will be appreciated that each of these actions may produce a different frequency of vibration. For example, a person attempting to climb the fence will produce an entirely different disturbance of the conduit 15 than a person attempting to saw the fence. It has been determined by a number of tests that rigid conduit, unlike the so-called "thinwall" conduit, tends to transmit a wide range of frequencies. Furthermore, because of the wall being relatively thick, there is relatively little attenuation in the vibration. In other words, it is not damped out as much as is the case with thinwall conduit. The result is that regardless of the frequency of the vibration produced by the attempted intrusion, this vibration is transmitted with relatively little attenuation to the box 17. Vibration of the box will in turn produce vibration of the sensor 31 and a corresponding vibration of the piezoelectric element 48. The vibration imparted to the piezoelectric element will cause the piezoelectric element to vibrate at a frequency determined by the weight 51. Typically, the piezoelectric element tends to have a pronounced vibratory output of about 2000 Hz. Actually, the output of the piezoelectric element 48 is not confined to this frequency but ccurs over a relatively wide frequency range. The net effect is that the piezoelectric element 48 will produce a voltage of frequency which is predominantly around 2000 Hz but which may vary over a much wider range.

As has been previously explained, the sensors 31 are connected in parallel to conductors 63 and 64. These sensors 31 are connected in separate groups as shown in FIG. 7 and as has been previously described. Thus, sensors **31*a* will be associated with one section of the fence, sensors 31*b* with another section of the fence, and sensors 31*c* with still another section of the fence. Considering now the operation of sensors 31*a*, the presence of a disturbance at any of these sensors, above a predetermined amplitude, will, as previously explained, affect the output of driver amplifier 95*a* to deenergize the relay coil 98*a* of relay 97*a* to cause opening of relay switch blade 101*a* to deenergize relay coil 106 to allow closure of contact 107. This, as previously explained, will cause the actuation of the alarm 111 which may be located at some remote point such as a police station. A similar action will occur if a vibration is detected by sensors 31*b*. In this case, it will be the relay coil 97*b* that is deenergized to result in opening of relay switch 101*b*. This likewise will cause deenergization of relay coil 106 and energization of the alarm 111. Similarly, if a vibration is sensed by sensors 31*c*, the relay coil of relay 97*c* will be deenergized and the relay switch 101*c* will be opened to deenergize relay 105 and cause the alarm 111 to be energized. As the operation has been described to date, it makes no difference in what section of the fence the disturbance occurs. The apparatus is designed, as previously pointed out, to locate the nature of the disturbance and to enable the disturbance to be more carefully analyzed. Thus, referring again to a disturbance being sensed by one of the sensors 31*a*, the resulting output of the multivibrator 91*a*, as previously explained, will cause the trigger circuit 112*a* to be actuated for a period of time determined by the length of the output from integrator 93*a*. This will cause an output at the trigger circuit output terminal 115*a* which will energize the driver amplifier 116*a* to cause in turn illumination of lamp 117*a*. Similarly, if a disturbance is sensed by any of the sensors 31*b*, the driver amplifier 116*b* will be effective to cause energization of the lamp 117*b*. Likewise, if the disturbance is one sensed by one of the sensors 31*c*, it will be the lamp 117*c* which is energized. As previously explained, the lamps 117*a*, 117*b*, and 117*c* are visible from the front of the main control panel. It is thus possible for one looking at the panel to determine the section of the fence in which the disturbance has occurred. At the same time, the driver amplifier 120 is connected to the outputs of all three trigger circuits 112*a*, 112*b* and 112*c* so that upon any one of these trigger circuits being activated, an input voltage is supplied to the driver amplifier 120 to cause operation of the horn 121**. This horn is located in the control panel or immediately adjacent thereto and is effective to call attention to the fact that some disturbance has occurred along the fence.

The guard, or other person in charge of guarding against intrusion, can then look at the panel and by observing which of the lights **117*a*, 117*b* or 117*c* is illuminated determine in which section of the fence the disturbance has occurred. It is then possible by operation of the selector switch 136 to connect power amplifier 123 to the output of the appropriate one of the amplifiers 80*a*, 80*b* and 80*c*. The output of this amplifier is then passed through the power amplifier 123 to the speaker 124. The gain of power amplifier 123 is sufficiently large and the speaker 124** has a sufficiently wide range of response that it is possible by listening to the output of the speaker to obtain some idea about the character of the disturbance being produced and how continuous it is.

At the same time, the operation of the selector switch 136 to the position corresponding to which of the lights **117*a*, 117*b* and 117*c* is illuminated, also causes the input of the buffer amplifier 125 to be connected to the output of the appropriate one of the integrators 93*a*, 93*b* and 93*c*. This will, in turn, cause a signal to be transmitted to the meter 126 which is energized in accordance with the integrated output of the multivibrator 91*a*. The meter 126** thus has an indication which is dependent upon the frequency of the disturbances being produced along the fence. A trained operator can thus determine not only the approximate loation of the disturbance along the fence but can also determine the nature of it, simply by observing the readings on the control panel.

CONCLUSION

It will be seen that we have provided an intrusion detection system for use with a fence in which a wide range of frequencies can be transmitted to a sensor with relatively little attenuation. It is furthermore possible, when any disturbance occurs along the fence, to determine in what section the disturbance has occurred and then to examine the nature of the disturbance, simply by observation of various equipment associated with the central control box. At the same time, an alarm is sounded at a remote point.

While we have shown a specific embodiment of our invention for purposes of illustration, it is to be understood that the scope of the invention is limited solely by that of the appended claims.

We claim:

1. In combination with a fence enclosing an area to be protected against intrusion and supported by a plurality of spaced, rigid, substantially vertical fence posts, an intrusion detection system comprising:

a plurality of sections of relatively rigid electrical conduit supported on and in contact with said fence serially therealong and independently of said fence posts so that relatively small vibrations of such fence causes vibration of said conduit in contact therewith, said conduit being of ferrous material and having a wall thickness between approximately 0.10 and 0.12 inches, a plurality of liquid tight housings, each interposed between and having a threaded, liquid tight connection with two adjacent sections of said conduit so that said sections are serially connected together by said housings, a vibration sensor secured in each of said housings and responsive to vibrations transmitted to the housing in which it is located, each of said vibration sensors being effective to produce a vibratory electrical signal upon said conduit being vibrated, an indicating device, and connecting means operatively connecting a group of said sensors to said indicating device.

2. The combination of claim 1 in which the vibration sensor comprises a piezoelectric element designed to operate within the range of frequencies occurring in said conduit when the fence is disturbed.

3. The combination of claim 1 in which said connecting means includes a band pass amplifier connected between a group of said sensors and said indicating device.

4. The combination of claim 3 in which the output of said band pass amplifier is integrated and in which said indicating device is responsive to the integrated output of said band pass amplifier.

5. The combination of claim 3 in which there are a plurality of such band pass amplifiers, each of which is connected to a separate group of said sensors, and in which there are two indicating devices, one of which is collectively controlled by all of said amplifiers and the other of which is selectively connected to said amplifiers, one at a time.

6. The combination of claim 1 in which the sensors are arranged in groups in which there are a plurality of indicating devices, and in which when a disturbance is sensed by a sensor in any one group, an indicating device associated with said group is actuated and a further indicating device common to all of said groups is also energized.

7. The combination of claim 1 in which electrical conductors extend loosely through said sections of conduit and interconnect said sensors to said connecting means.

8. The combination of claim 7 in which said conductors are in the form of a flexible coaxial cable.

* * * * *